US010760310B2

(12) United States Patent
Kessler

(10) Patent No.: US 10,760,310 B2
(45) Date of Patent: Sep. 1, 2020

(54) REPLACEMENT DOOR HINGES FOR ALIGNING A DOOR IN RELATION TO A DOOR JAMB

(71) Applicant: Tyler Kessler Holdings Inc., Overland Park, KS (US)

(72) Inventor: Tyler L. Kessler, Overland Park, KS (US)

( * ) Notice: Subject to any disclaimer, the term of this patent is extended or adjusted under 35 U.S.C. 154(b) by 0 days.

(21) Appl. No.: 16/354,771

(22) Filed: Mar. 15, 2019

(65) Prior Publication Data

US 2019/0211596 A1 Jul. 11, 2019

Related U.S. Application Data

(63) Continuation-in-part of application No. 15/153,393, filed on May 12, 2016, now Pat. No. 10,246,916.

(60) Provisional application No. 62/160,407, filed on May 12, 2015.

(51) Int. Cl.

| | |
|---|---|
| ***E05D 15/00*** | (2006.01) |
| ***E05D 5/04*** | (2006.01) |
| ***E05D 3/02*** | (2006.01) |

(52) U.S. Cl.

CPC ..... *E05D 5/04* (2013.01); *E05D 3/02* (2013.01); *E05Y 2800/72* (2013.01); *E05Y 2900/132* (2013.01)

(58) Field of Classification Search

CPC ..... E05D 5/14; E05D 3/02; E05Y 2900/132; Y10T 16/558; Y10T 16/5326

See application file for complete search history.

(56) References Cited

U.S. PATENT DOCUMENTS

| | | | | |
|---|---|---|---|---|
| 226,306 | A | 4/1880 | Gordon | |
| 477,465 | A | 6/1892 | Smith | |
| 480,238 | A | 8/1892 | Ranker | |
| 880,317 | A | 2/1908 | Von de Marwitz | |
| 1,105,666 | A | 8/1914 | Johnson | |
| 1,474,418 | A | 11/1923 | Larson | |
| 1,606,048 | A | 11/1926 | Soss | |
| 1,745,773 | A | 2/1930 | Sipe | |
| 2,004,810 | A | 6/1935 | Hines | |
| 2,112,312 | A | 3/1938 | Smith | |
| 2,144,863 | A * | 1/1939 | Webber | E05D 3/02 296/155 |
| 2,211,581 | A | 8/1940 | Ross | |

(Continued)

*Primary Examiner* — Jerry E Redman

(74) *Attorney, Agent, or Firm* — Christopher S. Ruprecht

(57) ABSTRACT

A kit for use in realigning a door connected to a jamb includes a plurality of replacement hinges having different sized gaps formed between the leaves thereof when pivoted to extend in parallel, juxtaposed alignment, including gaps that are narrower and wider than a standard gap of the conventional hinges currently used to hang the door, prior to installation. A zero gap replacement hinge may have no gap between the leaves when in the closed position. The kit may include multiple reduced gap replacement hinges with varying sized gaps and multiple enlarged gap replacement hinges with varying sized gaps. To rehang a sagging door, the top conventional hinge may be replaced with a reduced gap replacement hinge and the bottom conventional hinge may be replaced with an enlarged gap replacement hinge. The reduced gaps and the enlarged gaps of the replacement hinges may be formed using a swaging technique.

12 Claims, 7 Drawing Sheets

(56) References Cited

U.S. PATENT DOCUMENTS

| | | | |
|---|---|---|---|
| 2,330,455 | A | 9/1943 | Steckel |
| 2,940,115 | A | 6/1960 | Hansen |
| 3,229,323 | A | 1/1966 | Hensgen |
| 3,445,883 | A | 5/1969 | Lowe |
| 3,526,922 | A | 9/1970 | Kellems |
| 3,811,150 | A | 5/1974 | Chalmers |
| 4,825,507 | A | 5/1989 | Killingstad |
| 5,694,665 | A | 12/1997 | Strickland et al. |
| 5,701,636 | A | 12/1997 | Jahnke |
| 5,799,370 | A | 9/1998 | Davidian et al. |
| 6,158,086 | A | 12/2000 | De Souza |
| 7,162,774 | B1 * | 1/2007 | Von Resch ..... E05D 7/0054 16/236 |
| 7,516,517 | B2 | 4/2009 | Fries |
| 7,694,388 | B2 | 4/2010 | Campbell et al. |
| 8,490,246 | B2 | 7/2013 | Waddell |
| 2002/0162193 | A1 | 11/2002 | Frys |
| 2008/0052873 | A1 | 3/2008 | Campbell et al. |
| 2008/0276418 | A1 | 11/2008 | Peters et al. |
| 2012/0005859 | A1 | 1/2012 | Herglotz et al. |
| 2014/0020209 | A1 | 1/2014 | Hsu |
| 2014/0259523 | A1 | 9/2014 | Karcher |
| 2014/0298618 | A1 | 10/2014 | Karonis |

* cited by examiner

REPLACEMENT DOOR HINGES FOR ALIGNING A DOOR IN RELATION TO A DOOR JAMB

CROSS-REFERENCE TO RELATED APPLICATIONS

This application is a Continuation-in-Part of, and claims the benefit of priority from, U.S. Provisional Patent Application No. 62/160,407, filed May 12, 2015, and U.S. Non-provisional patent application Ser. No. 15/153,393, filed May 12, 2016, which has now issued as U.S. Pat. No. 10,246,916, the disclosure of which are hereby incorporated herein in their entirety by reference.

FIELD OF THE INVENTION

This invention relates to replacement door hinges for rehanging (and realigning) a door in a door frame (e.g., so the door does not sag and/or rub on the door jamb).

BACKGROUND

Due to their weight, heavy doors will often sag due to the strain exerted on the hinges and the door frame or jamb on which the doors are hung. Most solid wood doors are connected to the door frame by three hinges (although other numbers of hinges may be used). Gravity pulls downward on the door. For doors mounted to a frame by hinges on one side, the gravitational forces tend to pull the top of the door away from the hinge side of the frame and push the bottom of the door towards the hinge side of the frame.

The gravitational forces acting on the hinge leaves may cause the leaves of the top hinge to bend or distort. The leaf connected to the door is pulled away from the jamb and the leaf of the hinge connected thereto such that the spacing between the leaves increases. In addition, the wood forming the jamb at the top of the door frame on the hinge side may also be pulled away from the framing to which it is attached such that the top corner of the door opposite the top hinge gradually pivots into engagement with the top part of the jamb opposite the hinges.

Similarly, as gravity pulls the bottom of the door downward and toward the side of the door frame to which the hinges are connected, the leaves forming the bottom hinge may be compressed, narrowing the gap between the leaves. In addition, the outwardly or horizontally directed component of the gravitational forces acting on the hinge mounted door tend to compress the portion of the jamb to which the bottom hinge is connected or push that portion of the jamb outward which gradually pulls the opposite side of the bottom of the door away from the jamb opposite the hinges.

The gap (or clearance) between the door and the jamb may be referred to as a reveal, and a uniform reveal of approximately ⅛" or ¼", for example, may be formed between the door and the jamb to allow the door to pivot out from the frame without hitting the jamb. When a door sags in the manner described above, the reveal between the top corner of the door and the jamb opposite the top hinge is generally eliminated (or reduced), and the reveal between the top corner of the door and the jamb adjacent to the top hinge is widened. Similarly, the reveal between the bottom corner of the door and the jamb opposite the bottom hinge widens, and the reveal between the bottom corner of the door and the jamb adjacent to the bottom hinge is narrowed.

Options for repairing a sagging door have included driving longer screws through the holes of the leaf of the top hinge connected to the jamb to draw the top part of the jamb to which the hinge is attached outward. However, this is an inaccurate solution and may be ineffective in many cases of misaligned doors. It is also known to replace the standard hinges with an adjustable hinge, such as the adjustable hinge shown in U.S. Pat. No. 8,490,246, in which the leaf attached to the door incorporates an adjustment mechanism to adjust the width of the gap between the leaves of the hinge when the door is closed. However, the adjustable leaf of this hinge and similar type hinges is relatively thick requiring routing out a recess in the door or a deeper recess in the jamb to receive the thicker leaf. In addition, hinges including an adjustment mechanism are expensive to manufacture and purchase, are bulky, may require hiring a contractor to modify the door and/or the jamb to accommodate the adjustment mechanism, and installation thereof may otherwise cause damage to the door, jamb, and/or paint. Thus, hinges including an adjustment mechanism are not an ideal solution for modifying the width of the gap between leaves of the hinges to realign doors in frames.

There remains a need for an easier option for realigning a door in relation to the jamb (e.g., for repairing a sagging door) that is inexpensive to manufacture and purchase and is relatively easy to implement and install (e.g., does not require assistance of an expert contractor).

SUMMARY

Example embodiments of the inventive concepts involve altering the reveal of a door by replacing one or more of the currently installed, conventional hinges with one or more replacement hinges of different spacing between the leaves of the hinges in the closed position in which the hinges extend in parallel alignment. The replacement hinges may be sold individually or as a kit comprising multiple replacement hinges with different spacing between the hinge leaves and with instructions on installing the replacement hinges to achieve various types of adjustments. The replacement hinges and method are particularly suited for use with relatively heavy wood or composite doors mounted on wood frames, which may be used for an entry door for a residence or other solid core doors used in a residence. The replacement hinges used may include a first hinge or reduced gap replacement hinge having a reduced dimension gap between the leaves of the hinge when pivoted to a closed position in which the leaves extend in parallel, juxtaposed alignment. In some example embodiments, the reduced dimension gap may be zero or no gap. The reduced gap replacement hinge is often used to replace the top hinge of a door that has sagged, for example, although example embodiments are not limited thereto. The replacement hinges used may also include a second hinge or enlarged gap replacement hinge having an enlarged dimension gap between the leaves of the hinge when pivoted to a closed position with the leaves extending in parallel, juxtaposed alignment. In some example embodiments, there may be multiple reduced gap replacement hinges and/or multiple enlarged gap replacement hinges, each having gaps of different widths, so as to enable various amounts and types of adjustments to be made and thereby realign the door in the frame and obtain a more uniform reveal between the door and the jamb.

The change in the width of the gap between the leaves of the replacement hinges is created (e.g., using a metal bending technique known as swaging) without changing the general size of the knuckles or the pivot pin forming the replacement hinges. The gap formed between each of the replacement hinges is fixed and is not adjustable, and replacement hinges of a variety of different gap spacing may be produced to accommodate a wide variety of adjustments to the spacing between the door and the jamb. Use of the replacement hinges allows rehanging of a door relative to the jamb to eliminate the sagging, for example, without having to change the mortise size in the door and the jamb and without the use of wedges or shims. Once one or more of the conventional hinge(s) are replaced with one or more of the replacement hinge(s) so as to adjust the width of the reveal between the door and the jamb such that the door is realigned relative to the jamb and is able to open and close essentially without contacting the jamb, no further adjustment is necessary (that is, the desired adjustment is achieved simply by the replacement and no additional modifications or adjustment mechanisms are needed).

DETAILED DESCRIPTION

Figure 1:
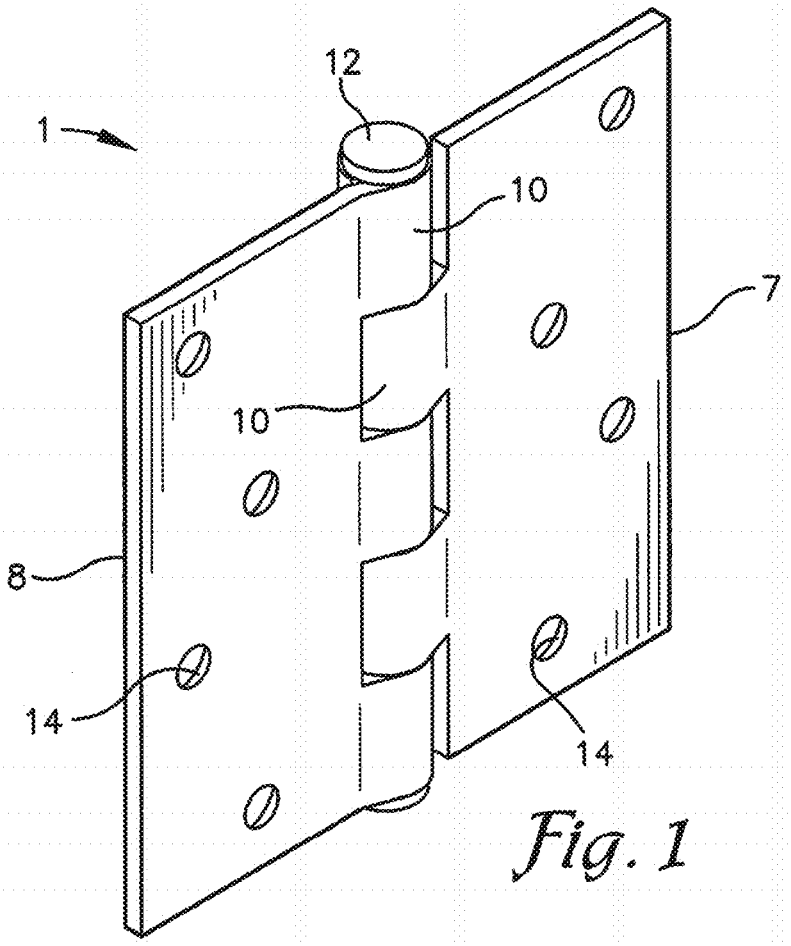
FIG. 1 is a perspective view of a conventional hinge for connecting a door to a jamb.

As required, some detailed example embodiments of the present inventive concepts are disclosed herein; however, it is to be understood that the disclosed example embodiments are non-limiting and the present inventive concepts may be embodied in various forms. Therefore, specific structural and functional details disclosed herein are not to be interpreted as limiting, but merely as a basis for the claims and as a representative basis for teaching one skilled in the art to variously employ the present inventive concepts in virtually any appropriately detailed structure. The drawings constitute a part of this specification and include example embodiments of the present inventive concepts and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the example embodiments being described and designated parts thereof. Said terminology will include the words specifically mentioned, derivatives thereof and words of a similar import.

Figure 2:
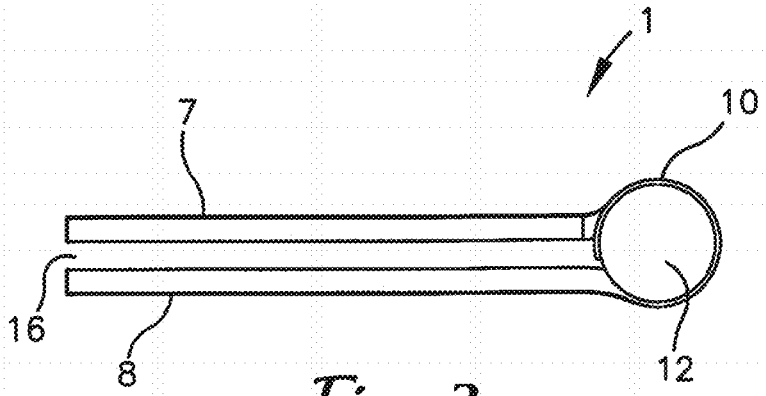
FIG. 2 is an end view of a conventional hinge in a closed position with the leaves of the conventional hinge extending in parallel spaced relation with a gap formed therebetween.
Figure 5:
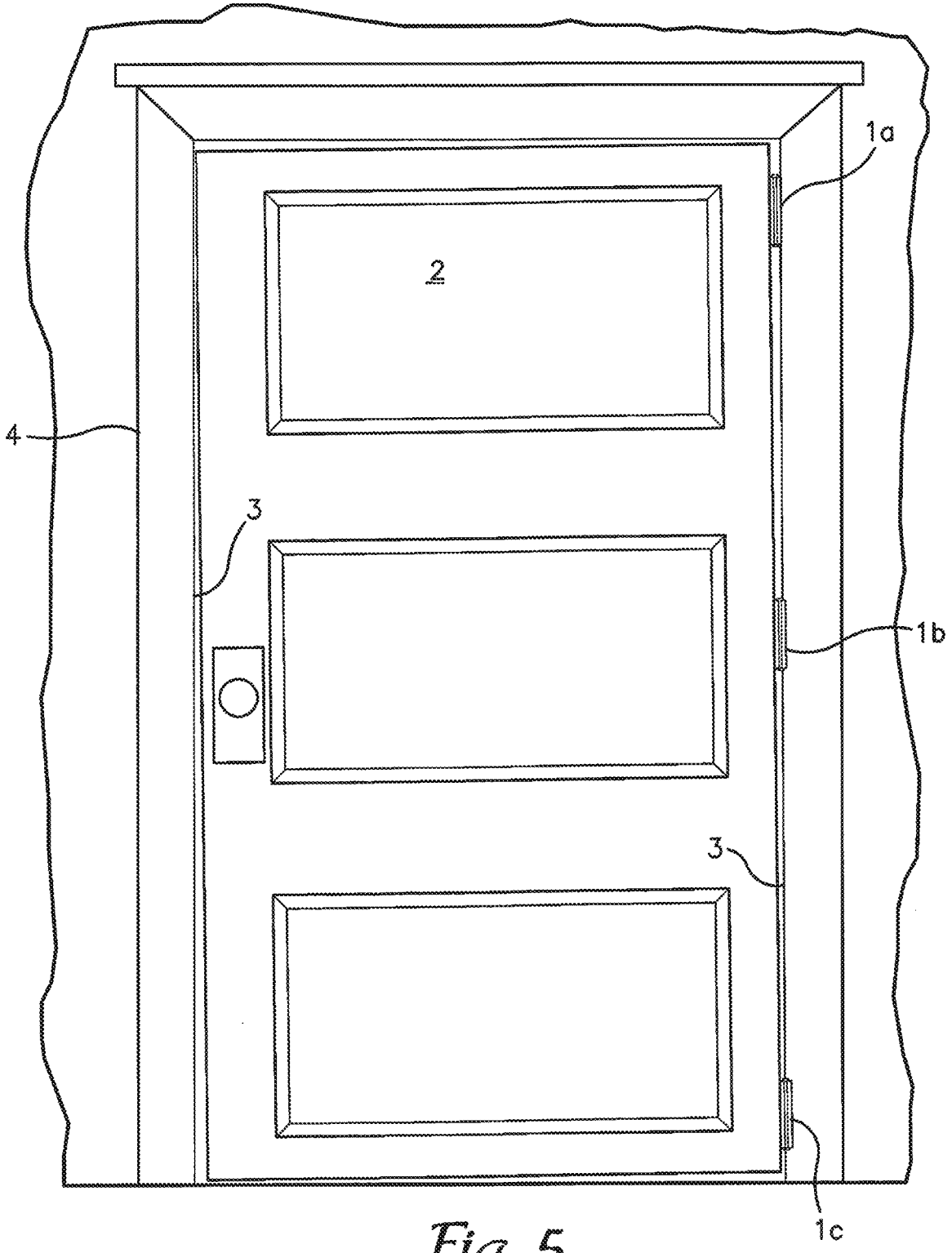
FIG. 5 is a diagrammatic view of a door hung in a door frame with the door connected to a jamb by three conventional hinges and showing the door sagging relative to the door frame. The dimensions and position of the hinges relative to the jamb are not to scale and are exaggerated to facilitate explaining the method of rehanging a door in a door frame and describing the hinges used.
Figure 6:
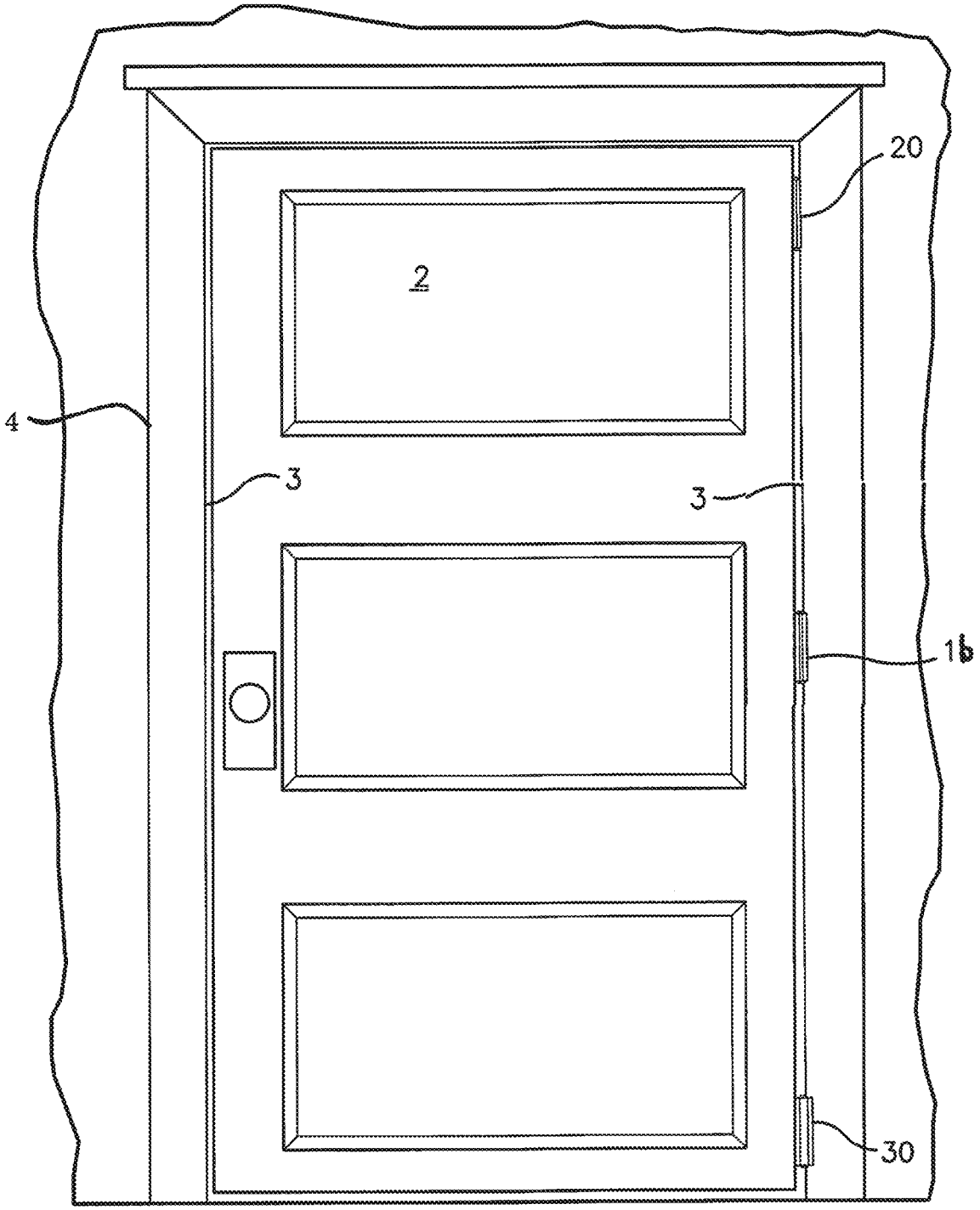
FIG. 6 is a diagrammatic view of the door shown in FIG. 5 with the upper conventional hinge replaced with the first replacement hinge and the lower conventional hinge replaced with the second replacement hinge. The dimensions and position of the hinges relative to the doorjamb are not to scale and are exaggerated to facilitate explaining the method of rehanging a door in a door frame and describing the hinges used.

A conventional hinge 1 for pivotally connecting a door 2 to a jamb 3 of a door frame 4 is shown in FIGS. 1 and 2. The conventional hinge 1 includes first and second leaves 7 and 8 each with a plurality of knuckles 10, which when aligned receive a hinge pin 12 therethrough about which the leaves 7 and 8 pivot. Fastener holes 14 are formed in each of the leaves 7 and 8 through which fasteners, such as wood screws, are driven to secure the leaves 7 and 8 to the door 2 or the jamb 3. The leaves 7 and 8 of the conventional hinge 1 project outward from their respective knuckles 10 such that, when the leaves are pivoted to a closed alignment with the leaves extending parallel and adjacent to one another, prior to installation, a gap 16 (also referred to as a "standard gap") is formed between the leaves 7 and 8. The gap 16 generally corresponds in width to the desired width of the reveal between the door 2 and the jamb. The desired width of the reveal between the door 2 and the jamb 3 may be about ¼" inch, for example. The gap 16 formed between the leaves 7 and 8 of the conventional hinges 1, prior to installation, is may be about 1/16" (e.g., between 0.05 inch and 0.1 inch wide). For example, for a 3.5" three screw hinge, the gap 16 may be 0.05" to 0.08" wide, and for a 4" four screw hinge, the gap 16 may be 0.06" to 0.1" wide. However, these are merely non-limiting illustrative examples, and various different sized conventional hinges (e.g., 3", 4.5",5", and/or 6" hinges) with different numbers of screw holes are also contemplated. For standard eight foot doors 2, three conventional hinges 1 are typically used to connect the door 2 to the jamb 3, including a top hinge 1*a*, a middle hinge 1*b*, and a bottom hinge 1*c*. However, some example embodiments are not limited thereto, and different numbers of hinges may be applicable depending on the size (e.g., height, width, thickness) and weight of the door (e.g., two hinges for smaller or lighter weight doors, and/or four or five hinges for larger or heavier weight doors). After installation, the weight of the door 2 may generally cause the gap 16 of the top hinge 1*a* to expand and the gap 16 of the bottom hinge 1*c* to compress, as shown in FIG. 5, such that the reveal between the door 2 and the jamb 3 is not uniform. For example, due to the gravitational forces expanding the gap 16 of the top hinge 1*a* and compressing the gap 16 of the bottom hinge 1*c*, an upper left corner of the door 2 opposite the hinge 1*a* may contact the jamb 3. Although not illustrated, other factors may also result in a non-uniform reveal after installation of the door 2, including settling of the residence over time, or inaccurate measurements.

Figure 3:
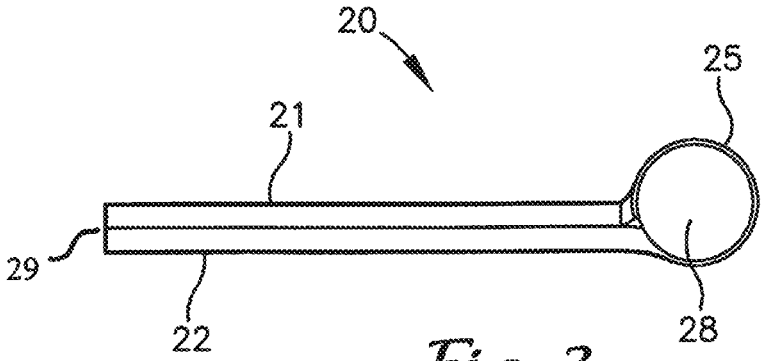
FIG. 3 is an end view of a first replacement hinge which has been modified to reduce the size of the gap or eliminate the gap between the leaves of the first replacement hinge when extending in parallel spaced relation.

Referring to FIG. 3, there is shown a first replacement hinge or reduced gap replacement hinge 20 having first and second leaves 21 and 22 projecting outward from knuckles 25 and through which the hinge pin 28 extends. In some example embodiments, the radial position of at least one of the leaf 21 and the leaf 22 is adjusted relative to respective knuckles 25 so that when the leaves 21 and 22 are rotated to a closed position in which the leaves 21 and 22 extend in parallel, juxtaposed alignment, and prior to installation, a reduced gap 29 (e.g., a nominal gap, or no gap) is formed between the leaves 21 and 22. A reduced gap replacement hinge 20 with no gap between the leaves 21 and 22 in the closed position may be referred to as a zero gap replacement hinge 20. In the case where the reduced gap 29 is 0" wide (zero gap), the leaves 21 and 22 may be described as extending in abutting relationship. The reduced gap 29 formed between the leaves 21 and 22 of the reduced gap replacement hinge 20 is narrower than the gap 16 (standard gap) formed between the leaves 7 and 8 of the conventional hinge 1 prior to installation. For example, for a 3.5" three screw reduced gap replacement hinge 20, the reduced gap 29 may be 0.0" to 0.03" wide, and for a 4" four screw reduced gap replacement hinge 20, the reduced gap 29 may be 0.0" to 0.04" wide. However, example embodiments of the present inventive concepts are not limited thereto, and various different sized reduced gap replacement hinges 20 (e.g., 3", 4.5",5", and/or 6" hinges) with different numbers of screw holes are also contemplated. The adjustment of the radial position of one or both of the leaves 21 and/or 22 of the reduced gap replacement hinge 20 may be performed using a metal bending technique known as swaging, which will be described further below in connection with FIGS. 8 and 9.

Figure 4:
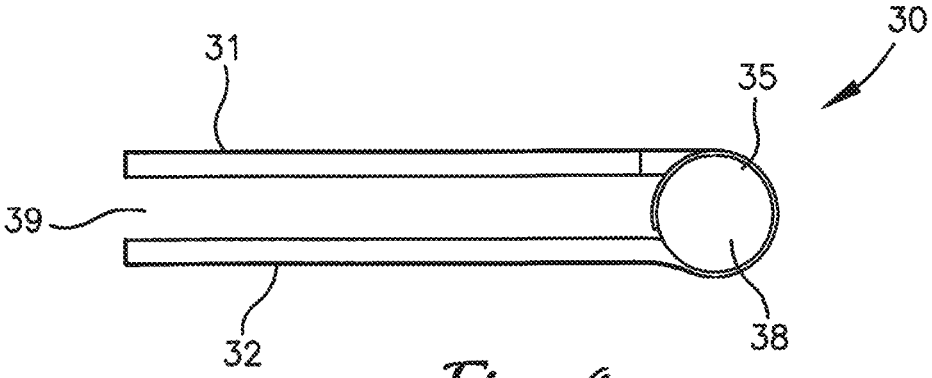
FIG. 4 is an end view of a second replacement hinge which has been modified to increase the size of the gap between the leaves of the second replacement hinge when extending in parallel spaced relation.

Referring to FIG. 4, there is shown a second replacement hinge or enlarged gap replacement hinge 30 having first and second leaves 31 and 32 projecting outward from knuckles 35 and through which the hinge pin 38 extends. In some example embodiments, the radial position of at least one of the leaf 31 and the leaf 32 is adjusted relative to respective knuckles 35 so that when the leaves 31 and 32 are rotated to a closed position in which the leaves 31 and 32 extend in parallel, juxtaposed alignment, and prior to installation, an enlarged gap 39 is formed between the leaves 31 and 32. For example, the radial position of at least one of the leaf 31 and the leaf 32 is adjusted to extend generally tangentially to the knuckles 35 to which it is attached, although example embodiments are not limited thereto. The enlarged gap 39 formed between the leaves 31 and 32 of the enlarged gap replacement hinge 30 is wider than the gap 16 (standard gap) formed between the leaves 7 and 8 of the conventional hinge 1 prior to installation. For example, for a 3.5" three screw enlarged gap replacement hinge 30, the enlarged gap 39 may be 0.15" to 0.3" wide, and for a 4" four screw enlarged gap replacement hinge 30, the enlarged gap 39 may be 0.15" to 0.3" wide. However, example embodiments of the present inventive concepts are not limited thereto, and various different sized enlarged gap replacement hinges 30 (e.g., 3", 4.5",5", and/or 6" hinges) with different numbers of screw holes are also contemplated. It is also foreseen that multiple enlarged gap replacement hinges 30 may be produced with variations in the width of the enlarged gap 39. For example, a first enlarged gap replacement hinge 30 may have an enlarged gap 39 that is 0.15" to 0.2" wide, and a second enlarged gap replacement hinge 30 may have an enlarged gap 39 that is 0.25" to 0.3" wide. Again, the adjustment of the radial position of one or both of the leaves 31 and/or 32 of the enlarged gap replacement hinge 30 may be performed using the swaging technique described below in connection with FIGS. 8 and 9.

In one non-limiting approach to rehanging a door 2 that has sagged, only the top hinge 1*a* might be replaced with a reduced gap replacement hinge 20. Replacing the top hinge 1*a* with the reduced gap replacement hinge 20 will pull the top hinge side corner of the door 2 closer to the upper portion of the jamb 3 on the hinge side and pull the opposite upper corner of the door 2 away from the jamb 3 opposite the reduced gap replacement hinge 20. This repair may be sufficient to correct the sagging of the door 2 by producing a more consistent reveal between the door 2 and the jamb 3 and eliminating (or reducing) the binding of the door 2 with the jamb 3.

In case further adjustment in needed to realign the door 2 relative to the jamb 3, in addition to replacing the top hinge 1*a* with the reduced gap replacement hinge 20, the bottom hinge 1*c* may be replaced with an enlarged gap replacement hinge 30. Replacing the bottom hinge 1*c* with the enlarged gap replacement hinge 30 will push the bottom hinge side corner of the door 2 away from the lower portion of the jamb 3 on the hinge side and push the opposite lower corner of the door 2 toward the jamb 3 opposite the enlarged gap replacement hinge 30 to produce a more consistent reveal between the door 2 and jamb 3 and eliminate (or reduce) any binding between the door 2 and the jamb 3.

Typically, the middle hinge 1*b* will not need to be replaced. However, in certain cases, the middle hinge 1*b* could also be replaced with a reduced gap replacement hinge 20 or an enlarged gap replacement hinge 30 according to some other example embodiments, depending on the amount and/or the type of adjustment needed.

When replacing the hinges 1*a* and/or 1*c* with the reduced gap replacement hinge 20 and/or the enlarged gap replacement hinge 30, respectively, an installer may reuse the screws used to secure hinges 1*a* and 1*c* to the door 2 and jamb 3. Alternatively, the installer may select slightly longer screws if preferred. In some example embodiments, fastener receiving holes (screw holes) formed in the replacement hinges 20 and 30 may be sized and spaced to correspond to the fastener holes 14 of conventional hinges 1. In some other example embodiments, it is also foreseen that the location of the screw holes in the leaves 21 and 22 of reduced gap replacement hinge 20 and the screw holes in the leaves 31 and 32 of the enlarged gap replacement hinge 30 may be modified relative to the fastener holes 14 in the leaves 7 and 8 of the conventional hinges 1, so that the fasteners (screws) used to connect the replacement hinges 20 and/or 30 to the door 2 and jamb 3 bore into different portions of the door 2 or jamb 3 (e.g., in case any existing screw holes drilled in the door 2 and/or the jamb 3 are worn or have been stripped).

Figure 7:
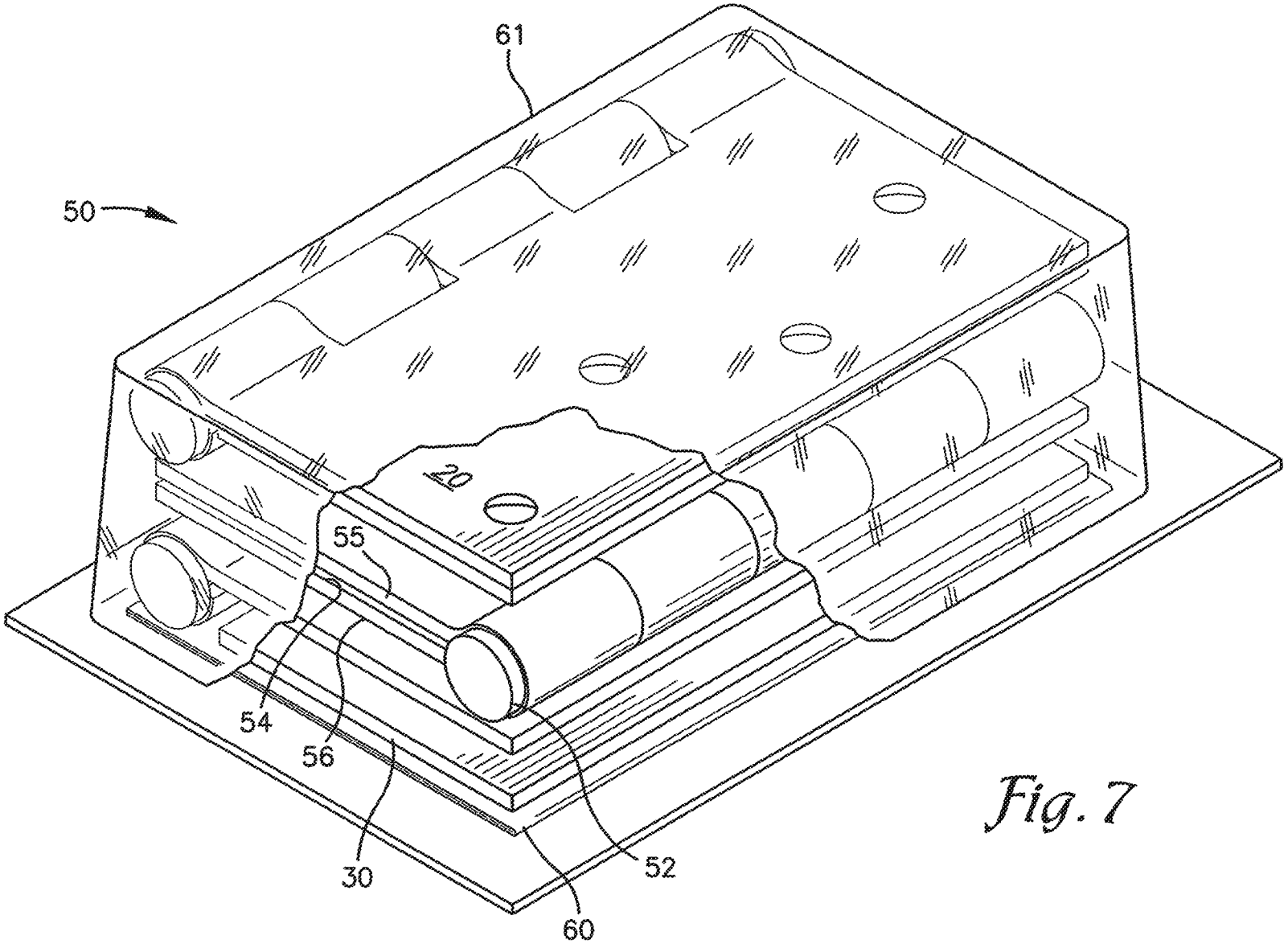
FIG. 7 is a perspective view of a kit including three replacement hinges and an instruction sheet for using the replacement hinges bundled together in a plastic package, according to some example embodiments.

Referring to FIG. 7, a kit 50 consisting of a reduced gap replacement hinge 20, an enlarged gap replacement hinge 30, and one or more additional replacement hinge(s) 52 having gaps of a variety of widths, along with a set of installation instructions 60, may be distributed through selected channels such as retail hardware stores and/or architectural hardware manufacturers. In some example embodiments, the kit 50 shown in FIG. 7 includes a first reduced gap replacement hinge 20, a second reduced gap replacement hinge 52, and one enlarged gap replacement hinge 30. The first reduced gap replacement hinge 20 may be a zero gap replacement hinge, as shown in FIG. 3. The second reduced gap replacement hinge 52 may have a gap 54 formed between leaves 55 and 56 extending in parallel, juxtaposed alignment, prior to installation, that is dimensioned greater than zero but less than the dimension of the gap 16 (standard gap) of a conventional hinge 1. In one non-limiting illustrative example, if the gap 16 of the conventional hinge 1 is about 1/16", the gap 54 of the second reduced gap replacement hinge 52 may be about 1/32". The second reduced gap replacement hinge 52 (non-zero gap) might be used in lieu of the first reduced gap replacement hinge 20 (zero gap) if the degree to which the door has sagged is limited or for other reasons relating to fit or spacing (e.g., only a minor adjustment is needed to realign the door in the frame). In some other example embodiments, the kit 50 may include a reduced gap replacement hinge 20 (which may have a nominal gap or no gap), a first enlarged gap replacement hinge 52, and a second enlarged gap replacement hinge 30. The second enlarged gap replacement hinge 30 might be used in lieu of the first enlarged gap replacement hinge 52 if the degree to which the door has sagged is substantial or for other reasons relating to fit or spacing (e.g., a greater amount of adjustment is needed to realign the door in the frame). In yet some other example embodiments, the additional replacement hinge 52 may have a standard gap width (e.g., about 1/16") similar to the conventional hinges 1 and may be used to replace the middle hinge 1*b* if desired by the installer, for example (e.g., to ensure consistent size, shape, finish, etc. of all of the hinges used to rehang the door 2, in cases where the replacement hinges may not exactly match the conventional hinges being replaced). The installation instructions 60 may be packaged in a plastic shell type package 61 with the replacement hinges 20, 30, and 52, and may provide detailed step-by-step instructions and illustrations for enabling a user to install the replacement hinges in the manner described previously so as to obtain various amounts and/or types of adjustments, thereby obtaining the desired alignment, a more consistent reveal, and avoiding contact between the door 2 and the jamb 3 when opening and closing the door 2.

Alternatively, it is foreseen that reduced gap replacement hinges 20 and enlarged gap replacement hinges 30 may be sold individually, and/or separately in packages of multiple of each (e.g., having reduced gaps or enlarged gaps of the same width or different widths), depending on the installer's needs. Reduced gap replacement hinges 20 and enlarged gap replacement hinges 30 of a variety of leaf shapes and finishes (e.g., whether standard or custom) may also be provided. For example, leaves 21 and 22 and leaves 31 and 32 may have square corners or rounded corners. The replacement hinges 20 and 30 may be manufactured with a variety of finishes, including brass or a silver finish, for example. In addition, the number of fastener holes (screw holes) formed in the leaves of the replacement hinges 20 and 30 may vary.

Figure 8:
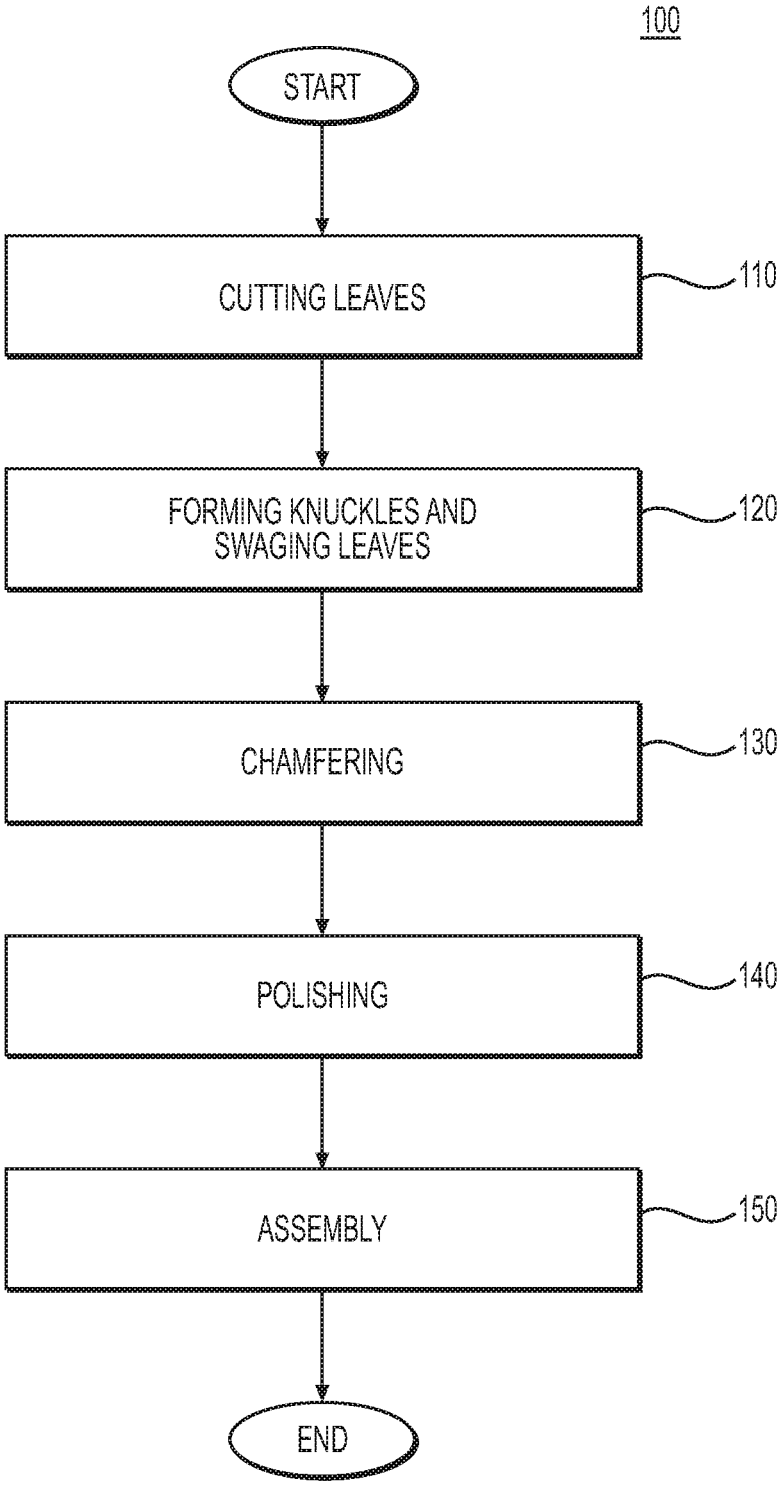
FIG. 8 is flow chart illustrating a process for manufacturing the replacement hinges according to some example embodiments.

Referring to FIG. 8, a flow chart illustrating a process 100 of manufacturing the replacement hinges (e.g., the reduced gap replacement hinge 20 and the enlarged gap replacement hinge 30) according to some example embodiments is described. The process 100 includes at least the following operations: cutting leaves (step 110), forming knuckles and swaging leaves (step 120), chamfering (step 130), polishing (step 140), and assembly (step 150). However, it should be noted that there may be additional well-known steps involved that are not disclosed, and that the order of some of the described operations may vary in some example embodiments.

In step 110, leaves of a desired size may be cut out (or punched) from sheet metal (e.g., steel, stainless steel, aluminum, brass, etc.). For example, a cutting mold and a power press machine may be used for the cutting step, although example embodiments are not limited thereto. For example, the leaves may have the same height (or length) as leaves of the conventional hinges that the replacement hinges are designed to replace (e.g., 3.5" or 4.0" hinges, although example embodiments are not limited thereto and various other leaf heights or lengths are also possible, such as 3.0", 4.5", 5.0", or 6.0"). The actual size of the leaves may depend on various factors such as the height, width, thickness, and/or weight of the door. When cutting the leaves, a number of tabs that will be used to form knuckles may also be cut. The number of tabs of a given leaf may depend on whether the leaf will be attached to the door or the jamb (e.g., among a pair of leaves, one leaf may have one, two, or three tabs and the other leaf may have two, three, or four tabs, although example embodiments are not limited thereto and other numbers of tabs are possible). The tabs of one leaf may align with respective cutouts of the other leaf, and vice versa. In some example embodiments, screw holes may also be cut out (or punched) from the sheet metal in step 110. The size, number, and/or position of the screw holes may depend on particular hinge specifications. In some other example embodiments, the screw holes may be cut (or drilled into the formed leaves) in step 130 below.

In step 120, knuckles are formed by bending (rolling, curling) the tabs. For example, a bending die or mold and a press machine such as a punch press, a press brake, or a hydroforming press may be used for the knuckle forming step. However, example embodiments are not limited thereto, and various known metal bending machinery and/or tools may be suitable for forming the knuckles from the tabs. In some example embodiments, the knuckles may be formed in a single hit or stroke (e.g., using a specialized or custom-designed bending die or mold). In some other example embodiments, the knuckles may be formed progressively in multiple hits or strokes (e.g., using multiple bending dies or molds). As a non-limiting illustrative example, a punch press, two forming tools, and three hits or strokes may bend the tabs to form the knuckles. Using a first forming tool, a first hit or stroke of the punch press creates a first bend at the end of the tabs to produce a leading edge of the tabs. In some example embodiments, this initial bend is typically 0.2" or less from the end of the tab and may have a 0.125" radius with an angle of about 20 degrees to 40 degrees, although example embodiments are not limited thereto. The purpose of this is to help guide the tab in a second forming tool (the leading edge of the tab will slide around the interior of the second forming tool during a third hit or stroke of the punch press to form a complete circle). Using the first forming tool, a second hit or stroke of the punch press creates a second bend at or near the midpoint of the tabs and in the same direction as the first bend. In some example embodiments, this second bend may have a 0.125" radius with a designed angle of about 75 degrees to 88 degrees, although some other example embodiments are not limited thereto. Then, using a second forming tool (also referred to as a "knuckle tool"), a third hit or stroke of the punch press rolls or curls the knuckles. The knuckle tool may include a half circle facing downward toward the leaf. As the punch press lowers the second forming tool down to the leaf, the leading edge of the raised tab enters the second forming tool making contact near the front edge of the second forming tool. As the second forming tool continues to descend, the tab is forced to slide around the interior perimeter of the second forming tool, thereby rolling or curling the tab around into a complete circle to form a knuckle. In some example embodiments, all of the tabs may be rolled or curled to form the knuckles at the same time. In some other example embodiments, the third hit or stroke may be repeated for each tab until all of the knuckles are formed for each leaf. However, it should be noted that example embodiments are not limited thereto, and various different machinery and numbers of tools, dies/molds, and/or hits or strokes may be used to implement the knuckle forming process.

In addition, one or both of the leaves may be swaged with respect to the knuckles (that is, with respect to the pin that will be inserted into the knuckles to attach the leaves together) in step 120. Swaging is a metal forming process in which the shape and/or dimensions of a work piece are altered using die(s) or mold(s) into which the work piece is forced. For example, swaging may be performed using a tool, die or stamp in a press (e.g., a punch press or a press brake machine). However, it should be noted that example embodiments are not limited thereto, and various different machinery and numbers of tools, dies/molds, and/or hits or strokes may be used to implement the swaging operation. A swaging operation includes forming (bending) one leaf or both of the leaves toward or beyond the center of the knuckles (that is, the centerline of the pin of an assembled hinge). Generally, swaging creates a slight inset of the leaf at or near the knuckles, which permits the leaves to come closer together when the hinge is in the closed position with the leaves extending in parallel. A leaf may be shifted with respect to the knuckles (pushed toward the pin). For example, the top side of a leaf may be moved to coincide with the plane of the centerline of the knuckles (or the pin). An amount of the swaging may be a function of an inner diameter of the knuckles (that is, the diameter of the pin). In some example embodiments, a swaging operation may be performed at the same time and using the same machinery and/or tools as the knuckle bending operation(s). In some other example embodiments, the swaging operation may be performed before or after the knuckle bending operation(s) and using different machinery and/or tools.

Figure 9:
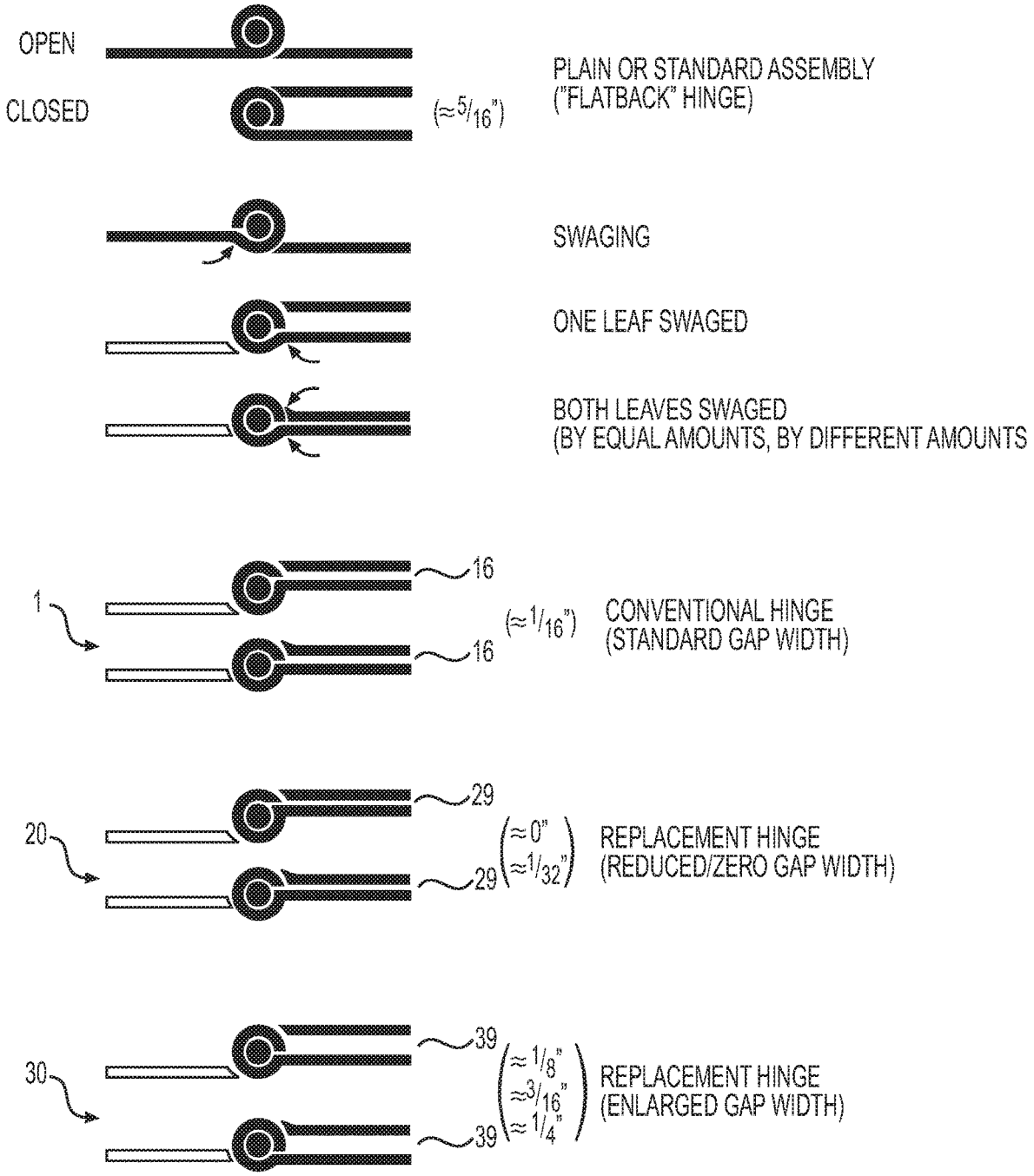
FIG. 9 illustrates various examples of swaging one leaf or both leaves of the replacement hinges according to some example embodiments, as compared to the conventional hinges.

Referring to FIG. 9, after the knuckles are formed for each of the leaves, and prior to the swaging operation, the leaves may be considered a plain or standard hinge assembly (also referred to as a "flatback" hinge). When in the open position, the leaves of a flatback hinge lay flat in the same plane. When in the closed position in which the leaves of the flatback hinge extend in parallel, juxtaposed alignment, there may be a gap of about 5/16" formed between the leaves prior to swaging. In some example embodiments, only one leaf is swaged. In some other example embodiments, both leaves may be swaged (e.g., by equal amounts or by different amounts). As is well-known in the related art, a conventional hinge 1 may be swaged and may have a gap 16 having a standard width of about 1/16" (also referred to as a "minimum clearance") formed between the leaves. According to some example embodiments, a reduced gap replacement hinge 20 may be swaged to a greater degree (as compared to the conventional hinge 1 being replaced) and may have a reduced gap 29 having a reduced width (e.g., a nominal gap width such as 1/32", although example embodiments are not limited thereto) or no gap (e.g., 0") formed between the leaves, and an enlarged gap replacement hinge 30 may be swaged to a lesser degree (as compared to the conventional hinge 1 being replaced) and may have an enlarged gap 39 having an enlarged width (e.g., about 1/8", 3/16", or 1/4", although example embodiments are not limited thereto) formed between the leaves. The degree (e.g., the exact amount) of the swaging of a leaf or leaves of a replacement hinge may be determined (e.g., calculated) as a function of a number of variables, and may depend not only on the inner diameter of the knuckles (the diameter of the pin), but also on the thickness (or gauge) of the leaves, whether only one leaf or both leaves are to be swaged (and whether both leaves are to be swaged by equal amounts or by different amounts), and the desired gap spacing between the leaves (e.g., the reduced gap 29 of the reduced gap replacement hinge 20 and the enlarged gap 39 of the enlarged gap replacement hinge 30, as compared to the standard gap 16 of the conventional hinge 1).

In step 130, a chamfering operation may be performed, which includes counter drilling the screw holes to form a recess to accommodate screw heads when installing the replacement hinges. In some example embodiments, in which the screw holes were not cut out (or punched) in step 110, the screw holes may be cut (or drilled) in step 130 prior to the chamfering operation. In step 140, the leaves may be polished. The polishing operation may also include cleaning, plating, and/or otherwise finishing surfaces of the replacement hinges according to particular hinge specifications. The polishing may be performed manually or semi-automatically with the assistance of polishing machinery. In step 150, the replacement hinges are assembled by aligning respective knuckles of a corresponding pair of leaves, and attaching the leaves together by inserting a pin into the aligned knuckles of the leaves. Again, the assembly may be performed manually or semi-automatically with the assistance of assembling machinery. Thus, the replacement hinges (e.g., the reduced gap replacement hinge 20 and the enlarged gap replacement hinge 30) are formed and ready for packaging.

In some example embodiments of process 100, specialized or custom-designed machinery and/or tools may be used to form the replacement hinges. In some other example embodiments of process 100, standard or conventional machinery and/or tools may be used. Which machinery and/or tools will be used may depend on various factors such as availability, costs, speed, accuracy, number of steps, etc. In addition, the above-described measurements may be approximate (e.g., within manufacturing tolerances), and may also be subject to various modifications depending on the particular application of the replacement hinges and/or on measurements of the conventional hinges to be replaced.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element is the language intended to be limited to one of the elements specified, or any other similarly limited number of element(s).

What is claimed is:

1. A set of replacement hinges having different gap spacing from each other and being included together in a package as a kit for rehanging a door connected to a jamb by a plurality of hinges, the set of replacement hinges consisting of:

at least three reduced gap replacement hinges having a pair of leaves with each leaf having a front surface and a rear surface that are both flat, planar and uniform surfaces along an entirety of said front and rear surfaces, connected via respective knuckles and a pin about which the pair of leaves are pivotable, and which when pivoted to a closed position in which the pair of leaves extend in parallel, juxtaposed alignment, prior to installation, have a fixed, non-adjustable, reduced dimension gap formed therebetween which is narrower than a gap formed between leaves of the plurality of hinges when in the closed position; and at least three enlarged gap replacement hinges having a pair of leaves with each leaf having a front surface and a rear surface that are both flat, planar and uniform surfaces along an entirety of said front and rear surfaces, connected via respective knuckles and a pin about which the pair of leaves are pivotable, and which when pivoted to a closed position in which the pair of leaves extend in parallel, juxtaposed alignment, prior to installation, have a fixed, non-adjustable, enlarged dimension gap formed therebetween which is wider than the gap formed between leaves of the plurality of hinges when in the closed position, the replacement hinges being selectable to replace one or more of the plurality of hinges so as to adjust a width of a reveal between the door and the jamb such that, after installation of one or more of the replacement hinges, the door is realigned relative to the jamb and is able to open and close essentially without contacting the jamb.

2. The set of replacement hinges according to claim 1, wherein the plurality of hinges and the replacement hinges are 3.5" three screw hinges, and prior to installation, the gap of the plurality of hinges is 0.05" to 0.08" wide, the fixed, non-adjustable, reduced dimension gap of the at least three reduced gap replacement hinges is 0" to 0.03" wide, and the fixed, non-adjustable, enlarged dimension gap of the at least three enlarged gap replacement hinges is 0.15 to 0.3" wide.

3. The set of replacement hinges according to claim 2, wherein the at least three enlarged gap replacement hinges includes a first enlarged gap replacement hinge and a second enlarged gap replacement hinge, the fixed, non-adjustable, enlarged dimension gap of the first enlarged gap replacement hinge is 0.15" to 0.2" wide, and the fixed, non-adjustable, enlarged dimension gap of the second enlarged gap replacement hinge is 0.25" to 0.3" wide, one of the first enlarged gap replacement hinge and the second enlarged gap replacement hinge being selectable to replace one of the plurality of hinges depending on an amount of adjustment required to realign the door relative to the jamb and ensure that the door is able to open and close essentially without contacting the jamb.

4. The set of replacement hinges according to claim 1, wherein the plurality of hinges and the replacement hinges are 4" four screw hinges, and prior to installation, the gap of the plurality of hinges is 0.06" to 0.01" wide, the fixed, non-adjustable, reduced dimension gap of the at least three reduced gap replacement hinges is 0" to 0.04" wide, and the fixed, non-adjustable, enlarged dimension gap of the at least three enlarged gap replacement hinges is 0.15" to 0.3" wide.

5. The set of replacement hinges according to claim 4, wherein the at least three enlarged gap replacement hinges includes a first enlarged gap replacement hinge and a second enlarged gap replacement hinge, the fixed, non-adjustable, enlarged dimension gap of the first enlarged gap replacement hinge is 0.15" to 0.2" wide, and the fixed, non-adjustable, enlarged dimension gap of the second enlarged gap replacement hinge is 0.25" to 0.3" wide, one of the first enlarged gap replacement hinge and the second enlarged gap replacement hinge being selectable to replace one of the plurality of hinges depending on an amount of adjustment required to realign the door relative to the jamb and ensure that the door is able to open and close essentially without contacting the jamb.

6. The set of replacement hinges according to claim 1, wherein the replacement hinges are selectable to replace one or more of the plurality of hinges to enable a position or orientation of the door in relation to the jamb to be adjusted in different ways upon installation, depending on a type of adjustment required to realign the door relative to the jamb and ensure that the door is able to open and close essentially without contacting the jamb, including any of, replacing at least two of the plurality of hinges with at least two of the reduced gap replacement hinges to pull the door towards a hinge side of the jamb, replacing at least two of the plurality of hinges with at least two of the enlarged gap replacement hinges to push the door away from the hinge side of the jamb, replacing an uppermost hinge of the plurality of hinges with one of the reduced gap replacement hinges, and replacing a lowermost hinge of the plurality of hinges with one of the enlarged gap replacement hinges, to rotate the door in a clockwise direction relative to the jamb, and replacing the uppermost hinge of the plurality of hinges with one of the enlarged gap replacement hinges, and replacing the lowermost hinge of the plurality of hinges with one of the reduced gap replacement hinges, to rotate the door in a counterclockwise direction relative to the jamb.

7. The set of replacement hinges according to claim 6, the package including the replacement hinges further consisting of a set of installation instructions including detailed step-by-step instructions and illustrations for enabling a user to install the replacement hinges to adjust the position or orientation of the door in relation to the jamb in different ways upon installation depending on the type of adjustment required to realign the door relative to the jamb and ensure that the door is able to open and close essentially without contacting the jamb.

8. The set of replacement hinges according to claim 1, wherein the pair of leaves of the reduced gap replacement hinges and the pair of leaves of the enlarged gap replacement hinges each have a thickness and dimensions similar to each other, and similar to a thickness and dimensions of the leaves of the plurality of hinges, and installing the replacement hinges does not require any structural modification to the door or to the jamb.

9. The set of replacement hinges according to claim 1, wherein the fixed, non-adjustable, reduced dimension gap of the reduced gap replacement hinges and the fixed, non-adjustable, enlarged dimension gap of the enlarged gap replacement hinges are formed using a swaging technique, one leaf of the reduced gap replacement hinges are swaged to a greater degree than one leaf of the plurality of hinges, and one leaf of the enlarged gap replacement hinges are swaged to a lesser degree than one leaf of the plurality of hinges.

10. The set of replacement hinges according to claim 1, wherein the fixed, non-adjustable, reduced dimension gap of the reduced gap replacement hinges and the fixed, non-adjustable, enlarged dimension gap of the enlarged gap replacement hinges are formed using a swaging technique, both leaves of the reduced gap replacement hinges are swaged to a greater degree than both leaves of the plurality of hinges, and both leaves of the enlarged gap replacement hinges are swaged to a lesser degree than both leaves of the plurality of hinges.

11. The set of replacement hinges according to claim 1, wherein the leaves of the reduced gap replacement hinges are each swaged by equal amounts, and the leaves of the enlarged gap replacement hinges are each swaged by equal amounts.

12. The set of replacement hinges according to claim 1, wherein the leaves of the reduced gap replacement hinges are each swaged by different amounts, and the leaves of the enlarged gap replacement hinges are each swaged by different amounts.

* * * * *